US012440009B2

(12) United States Patent
Luo

(10) Patent No.: US 12,440,009 B2
(45) Date of Patent: Oct. 14, 2025

(54) ELECTRICALLY-OPERATED UMBRELLA

(71) Applicant: Phaeton Manufacturing LLC, Jiangsu (CN)

(72) Inventor: Xiong Luo, Jiangsu (CN)

(73) Assignee: Phaeton Manufacturing LLC, Nantong (CN)

( * ) Notice: Subject to any disclaimer, the term of this patent is extended or adjusted under 35 U.S.C. 154(b) by 302 days.

(21) Appl. No.: 18/550,842

(22) PCT Filed: Mar. 1, 2022

(86) PCT No.: PCT/CN2022/078516
§ 371 (c)(1),
(2) Date: Sep. 15, 2023

(87) PCT Pub. No.: WO2022/193936
PCT Pub. Date: Sep. 22, 2022

(65) Prior Publication Data

US 2024/0156223 A1 May 16, 2024

(30) Foreign Application Priority Data

Mar. 19, 2021 (CN) ..... 202110295063.4

(51) Int. Cl.
*A45B 25/14* (2006.01)
*A45B 25/02* (2006.01)
*A45B 25/16* (2006.01)

(52) U.S. Cl.
CPC ..... *A45B 25/143* (2013.01); *A45B 25/02* (2013.01); *A45B 25/165* (2013.01)

(58) Field of Classification Search
CPC ..... A45B 25/143; A45B 25/02; A45B 25/165
See application file for complete search history.

(56) References Cited

U.S. PATENT DOCUMENTS 3,053,266 A * 9/1962 Burns ..... A45B 19/02 52/2.17
3,870,062 A * 3/1975 Medlin ..... A45B 19/04 52/63

(Continued)

FOREIGN PATENT DOCUMENTS

DE 102017108418 A1 * 10/2018 ..... A45B 25/14

*Primary Examiner* — Noah Chandler Hawk
(74) *Attorney, Agent, or Firm* — Wang Law Firm, Inc.

(57) ABSTRACT

An electrically-operated umbrella comprises a column (1), an upper tray (2), a lower tray (3), a plurality of long rods (4), a plurality of short rods (5), and an electric air pump (6). One end of each short rod (5) is rotatably connected to the lower tray (3), the other end of each short rod (5) is rotatably connected to the middle portion or the upper portion of the corresponding long rod (4); the column (1) comprises an inner tube (11), and an outer tube (12), the outer tube (12) is sleeved around the inner tube (11); a closed air chamber (A) is defined between the bottom of the inner tube (11) and the bottom or the lower portion of the outer tube (12); the upper tray (2) is connected to the top of the inner tube (11), the lower tray (3) is connected to the outer tube (12) and sleeved around the outer tube (12); the electric air pump (6) is disposed inside the inner tube (11). The present invention is simple in structure, easy and quick to operate, free of lots of structural members, and low in cost. The service life of the umbrella is prolonged, umbrella becomes safer and more reliable in use, and the user experience is greatly improved.

9 Claims, 4 Drawing Sheets

(56) References Cited

U.S. PATENT DOCUMENTS

| | | | | |
|---|---|---|---|---|
| 4,011,881 | A * | 3/1977 | Becher | E04B 1/3441 135/33.4 |
| 4,424,824 | A * | 1/1984 | Becher | A45B 19/04 135/20.3 |
| 4,747,422 | A * | 5/1988 | Chung | A45B 25/165 135/20.2 |
| 4,766,920 | A * | 8/1988 | Grady | A45B 25/165 135/22 |
| 6,202,660 | B1 * | 3/2001 | Steiner | A45B 25/14 135/22 |
| 6,371,140 | B1 * | 4/2002 | Atanda | A45B 25/18 135/25.4 |
| 6,772,777 | B1 * | 8/2004 | Mann | A45B 25/14 135/20.2 |
| 6,913,030 | B1 * | 7/2005 | Chmelik Martinec | A45B 19/02 135/20.2 |
| 9,016,295 | B2 * | 4/2015 | Wise | A45B 25/165 248/188.5 |
| 10,492,580 | B2 * | 12/2019 | Ma | A45B 25/14 |
| 10,602,816 | B2 * | 3/2020 | Handwerker | A45B 19/02 |
| 2005/0045217 | A1 * | 3/2005 | Clarke | A45B 19/04 135/20.3 |
| 2014/0096802 | A1 * | 4/2014 | Volin | A45B 25/143 135/16 |

* cited by examiner

ELECTRICALLY-OPERATED UMBRELLA

TECHNICAL FIELD OF THE INVENTION

The present invention relates to a field of an umbrella, and in particular to an electrically-operated umbrella.

BACKGROUND OF THE INVENTION

As a kind of outdoor leisure item, umbrellas are widely applied in squares, beaches, parks, gardens or similar places to shield individuals from sun. The existing umbrella is generally composed of a column, a rod frame and a canopy, wherein the rod frame is connected to the top of the column, the column mainly plays a role in supporting the rod frame, and the canopy is connected to the rod frame. When the rod frame is unfolded, the canopy is also unfolded, so that the umbrella is unfolded. The umbrella used outdoor requires a large canopy. At present, most umbrellas are operated manually or unfolded/folded by mechanisms such as motor-driven gears or worm gears.

In the prior art, the manually-operated umbrellas are time-consuming and labor-intensive, and the umbrellas with motor-driven gears or worm gear mechanisms have higher requirements for part machining and are relatively high in cost. The maintenance cost is also high when the umbrellas are damaged. Therefore, it is necessary to design an umbrella which is electrically-operated, easy to operate, low in cost and safer.

After searching, a Chinese Patent CN205072251U (patent No: CN201520724492.9) disclosed an electrically-operated umbrella using solar energy, comprising a body composed of a column, rods connected to the handle and a canopy covered on the rods; a folding/unfolding mechanism for controlling the rods to be folded or unfolded is arranged inside the column; a control box is arranged on the top of the column, and a main control board is arranged in the control box. The umbrella further comprises a wind speed detection unit detachably assembled on one side of the control box; and, a detected signal of the wind speed detection unit is transmitted to a control module on the main control board. This umbrella is powered by solar energy and can distinguish, according to the output current of the solar panel, whether it is in daytime or at night so as to unfold the umbrella body in the daytime and fold the umbrella body at night. The fully automatic operation is very convenient, but the cost is high and it is difficult to popularize. Although it is disclosed that the umbrella has a folding/unfolding mechanism, the specific structure of the folding/unfolding mechanism has not been described.

SUMMARY OF THE INVENTION

It is an object of the present invention to provide an electrically-operated umbrella which is simple in structure, easy to operate and low in cost.

For achieving the above object, the electrically-operated umbrella comprises a column; an upper tray; a lower tray; a plurality of long rods, each having a middle portion and an upper portion, each rotatably connected to the upper tray; a plurality of short rods having two ends; and an electric air pump. One end of each short rod is rotatably connected to the lower tray, the other end of each short rod is rotatably connected to the middle portion or the upper portion of the corresponding long rod. The column comprises an inner tube having a top and a bottom, and an outer tube having a top, a bottom and a lower portion, the outer tube is sleeved around the inner tube, the inner tube is capable of sliding up and down relative to the outer tube in a limited range of motion. A closed air chamber is defined between the bottom of the inner tube and the bottom or the lower portion of the outer tube. The upper tray is connected to the top of the inner tube, the lower tray is connected to the outer tube and sleeved around the outer tube. The electric air pump is disposed inside the inner tube to inflate or deflate the air chamber so as to drive the inner tube to slide up and down, and the upper tray is capable of sliding up and down with the inner tube relative to the outer tube and the lower tray, so as to drive the plurality of long rods and the plurality of short rods to rotate in order to fold or unfold the umbrella.

As an improvement, a piston movable with the inner tube is disposed at the bottom of the inner tube, a tube plug is disposed at the bottom of the outer tube or inside the lower portion of the outer tube, the closed air chamber inside the outer tube is defined between the piston and the tube plug; the electric air pump is located above the piston, the electric air pump has an air nozzle located at the bottom of the electric air pump, the air nozzle extends downward through the piston and communicates with the air chamber; when the umbrella frame is wholly unfolded, the electric air pump exhausts the air inside the air chamber, the piston moves downward with the inner tube relative to the outer tube to resist against the tube plug to maintain the unfolded umbrella frame, and the air chamber is a buffering area for an external force.

As an improvement, the piston is detachably connected to the bottom of the inner tube, and the tube plug is detachably connected to the outer tube.

Preferably, the piston has a vertical through hole at a middle portion of the piston for allowing the air nozzle to pass through, the piston has one or more radial connecting hole on a periphery of the piston, correspondingly, the inner tube has one or more threaded hole, the piston is connected to the inner tube through a bolt passing through the threaded hole and the corresponding connecting hole; the bottom of the piston extends out of the inner tube, and a first sealing ring is disposed between a periphery of the bottom of the piston and an inner wall of the outer tube.

Preferably, the tube plug has one or more radial connecting hole on a periphery of a lower portion of the tube plug, correspondingly, the outer tube has one or more threaded hole; the tube plug is connected to the outer tube through a bolt passing through the threaded hole and the corresponding connecting hole, and a second sealing ring is disposed between a periphery of an upper portion of the tube plug and the inner wall of the outer tube.

Preferably, a power module for supplying power to the electric air pump is disposed on the top of the inner tube at an upper end of the upper tray; the power module comprises a battery and a circuit board; and, the power module is electrically connected to the electric air pump in the inner tube through wires.

Preferably, the battery is a solar rechargeable battery, and the power module is equipped with a solar panel to charge the rechargeable battery.

Preferably, the circuit board may is a wireless control circuit, the umbrella is unfolded or folded by using a wireless device, and the wireless device comprises, but not limited to, a remote controller, a Bluetooth mobile phone, etc.

Finally, the lower tray is detachably connected to the outer tube and sleeved around the outer tube.

Compared with the prior art, the present invention has the following advantages. The column is composed of the outer tube and the inner tube, the upper tray is connected to the top of the inner tube, the lower tray is connected to the outer tube and sleeved around the outer tube, and the inner tube is driven by the pneumatic structure to slide up and down relative to the outer tube, so as to drive the upper tray to slide up and down relative to the lower tray and drive the plurality of long rods and the plurality of short rods to rotate in order to fold or unfold the umbrella. Since the closed air chamber inside the outer tube is defined between the piston and the tube plug, when the frame is subjected to an external force, for example, being blown by wind, the air chamber is a buffering area for the external force, thus prolonging the service life of the umbrella. The battery is a rechargeable battery with a solar panel, and the umbrella is controlled and operated by a wireless device, such as a remote controller or a Bluetooth mobile phone. The present invention is simple in structure, easy and quick to operate, free of lots of members, and low in cost. In addition, when the umbrella is in the unfolded state, the air chamber is a buffering area for the wind power. Thus, the service life of the umbrella is prolonged, umbrella becomes safer and more reliable in use, and the user experience is greatly improved, so that the product of the present invention is worth popularizing.

DETAILED DESCRIPTION OF THE INVENTION

The present invention will be further described below in detail by embodiments with reference to the accompanying drawings.

Figure 1:
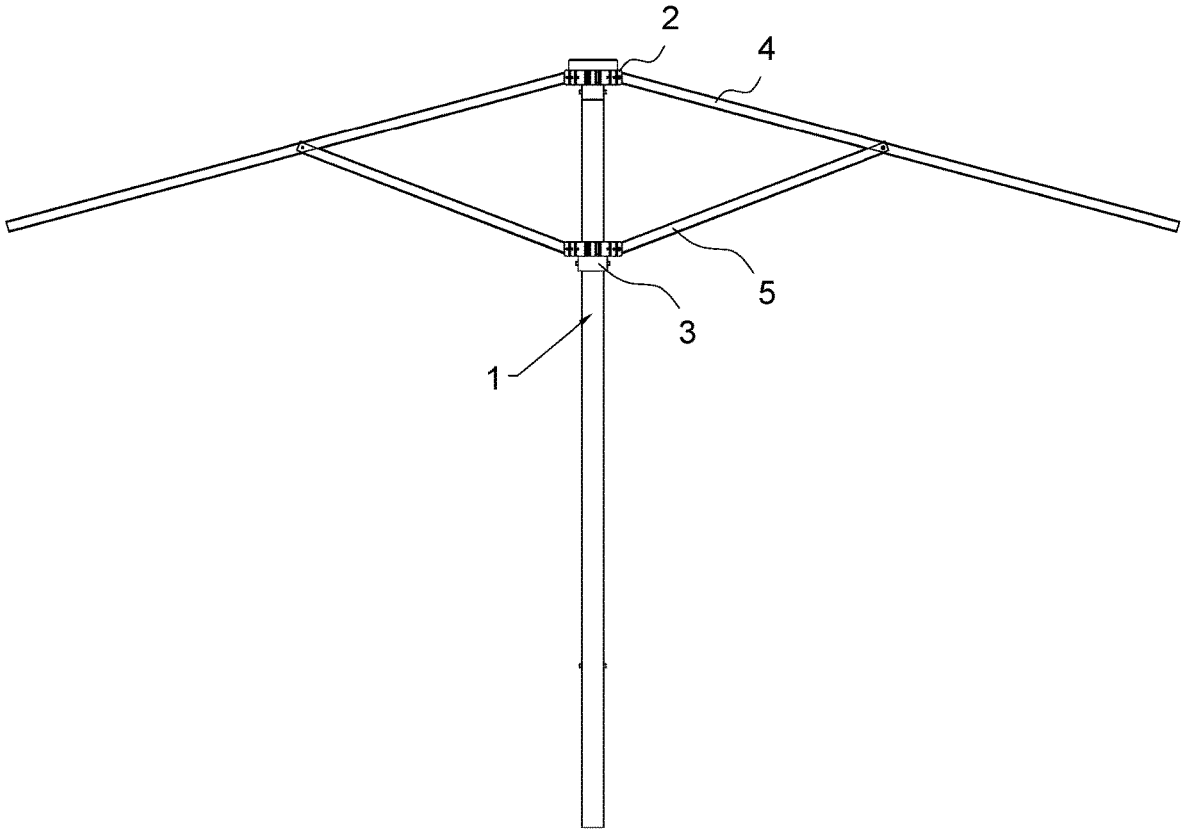
FIG. 1 is a front view of an electrically-operated umbrella according to an embodiment of the present invention.
Figure 2:
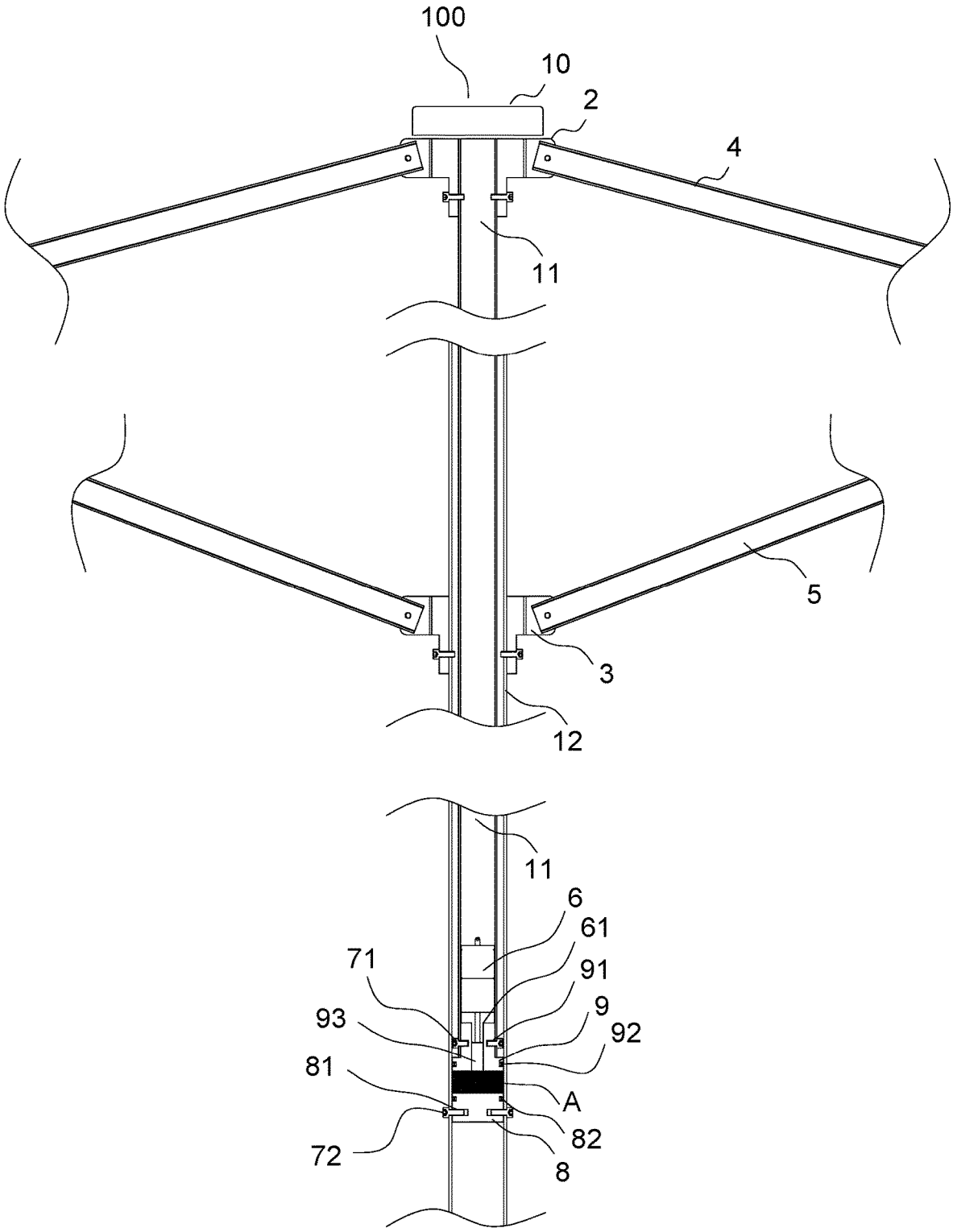
FIG. 2 is a vertically sectional view of a part of FIG. 1.
Figure 3:
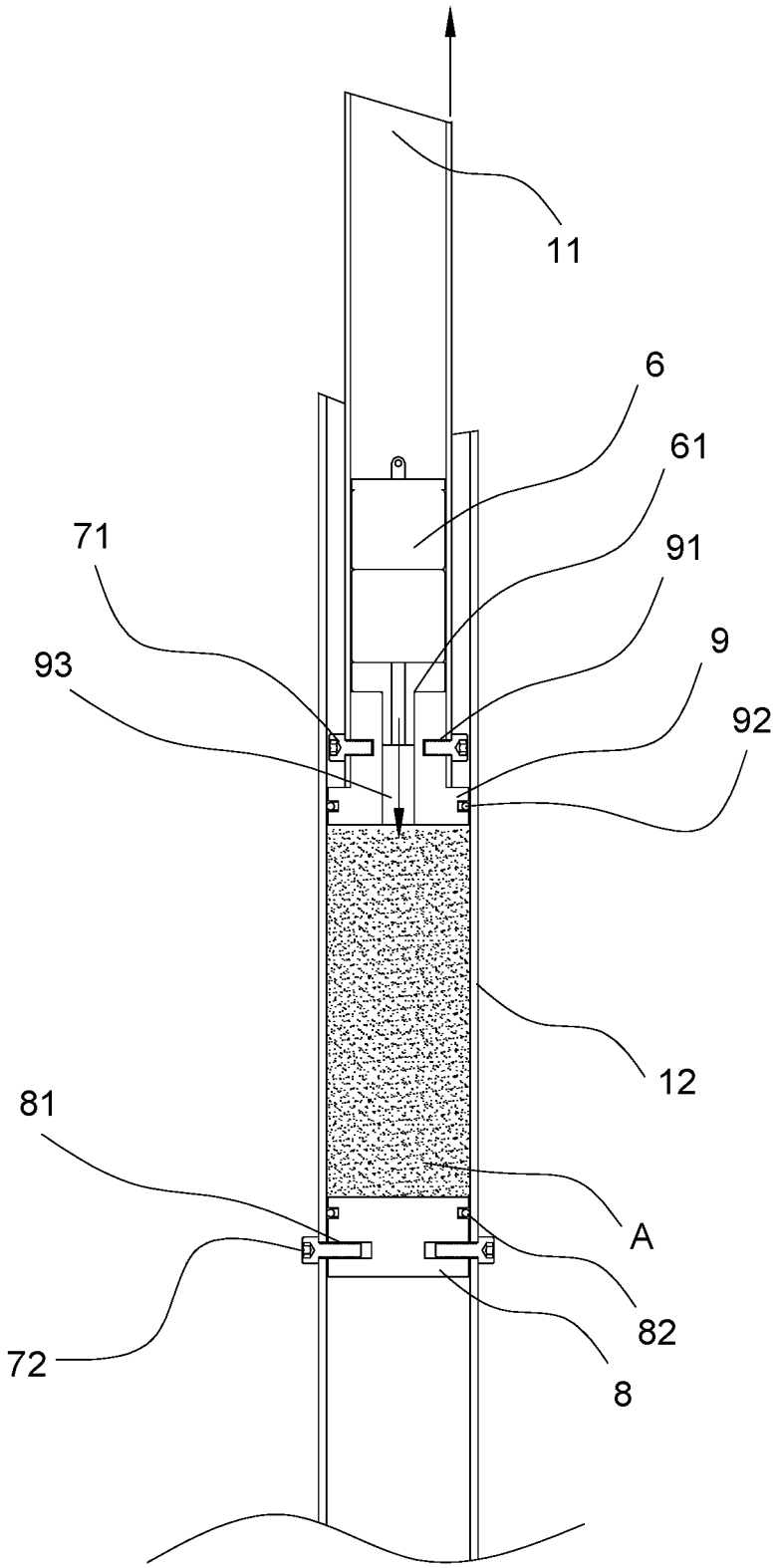
FIG. 3 is a sectional view of a part of an inner tube and an outer tube when the umbrella is folded according to the embodiment of the present invention.
Figure 4:
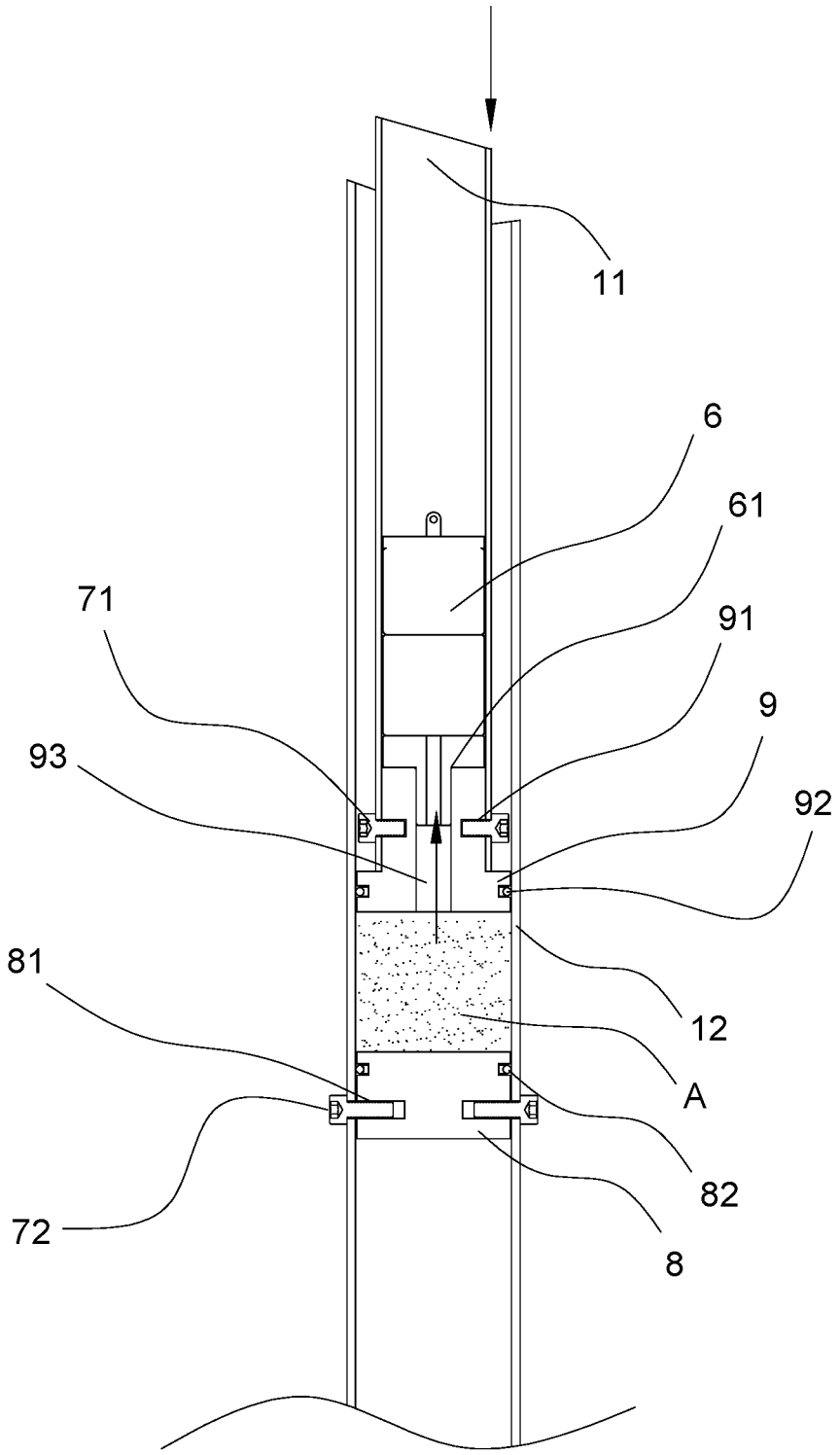
FIG. 4 is a sectional view of a part of the inner tube and the outer tube when the umbrella is unfolded according to the embodiment of the present invention.

As shown in FIGS. 1-4, the electrically-operated umbrella comprises an upper tray 2, a lower tray 3, a plurality of long rods 4, a plurality of short rods 5 having two ends, a column 1 and an electric air pump 6. Each long rod 4 has a middle portion and an upper portion and is rotatably connected to the upper tray 2. One end of each short rod 5 is rotatably connected to the lower tray 3, the other end of each short rod 5 is rotatably connected to the middle portion or the upper portion of the corresponding long rod 4, forming a umbrella frame. The column 1 comprises an inner tube 11 having a top and a bottom, and an outer tube 12 having a top, a bottom and a lower portion, the outer tube 12 is sleeved around the inner tube 11, the inner tube 11 is capable of sliding up and down relative to the outer tube 12 in a limited range of motion; a closed air chamber A is defined between the bottom of the inner tube 11 and the bottom or the lower portion of the outer tube 12. The upper tray 2 is fixedly connected to the top of the inner tube 11, the lower tray 3 is detachably connected to the outer tube 12 and sleeved around the outer tube 12. A electric air pump 6 is disposed inside the inner tube 11 to inflate or deflate the air chamber A so as to drive the inner tube 11 to slide up and down; and the upper tray 2 can slide up and down together with the inner tube 11 relative to the outer tube 12 and the lower tray 3, so as to drive the plurality of long rods 4 and the plurality of short rods 5 to rotate/move adaptively to perform a fold or unfold of the umbrella.

Specifically, a piston 9 movable with the inner tube 11 is detachably disposed at the bottom of the inner tube 11, a tube plug 8 is detachably disposed at the bottom of the outer tube 12 or inside the lower portion of the outer tube 12. The piston 9 has a vertical through hole 93 at a middle portion of the piston 9 for allowing the air nozzle 61 to pass through, the piston 9 has a plurality of radial connecting holes 91 on a periphery of the piston 9, correspondingly, the inner tube 11 has a plurality of threaded holes, the piston 9 is connected to the inner tube 11 through a plurality of bolts 71 each passing through the threaded hole and the corresponding connecting hole 91; the bottom of the piston 9 extends out of the inner tube 11, and a first sealing ring 92 is disposed between a periphery of the bottom of the piston 9 and an inner wall of the outer tube 12 so as to realize sealing. The tube plug 8 has a plurality of radial connecting holes 81 on a periphery of a lower portion of the tube plug 8, correspondingly, the outer tube 12 has a plurality of threaded holes; the tube plug 8 is connected to the outer tube 12 through a plurality of bolts 72 each passing through the threaded hole and the corresponding connecting hole 81, and a second sealing ring 82 is disposed between a periphery of an upper portion of the tube plug 8 and the inner wall of the outer tube 12 so as to realize sealing. Therefore, the closed air chamber A inside the outer tube 12 is defined between the piston 9 and the tube plug 8, when the umbrella frame is subjected to an external force, for example, the wind power, the air chamber A can be a buffering area for such an external force. The electric air pump 6 is located above the piston 9, the electric air pump 6 has an air nozzle 61 located at the bottom of the electric air pump 6, the air nozzle 61 extends downward through the piston 9 and communicates with the air chamber A. The air chamber A is inflated or deflated by the electric air pump 6.

A power module 100 for supplying power to the electric air pump 6 is disposed on the top of the inner tube 11 and the top of the upper tray 2, the power module 100 comprises a battery and a circuit board, and the power module 100 is electrically connected to the electric air pump 6 inside the inner tube 11 through wires. The battery is a solar rechargeable battery in this embodiment, and the power module 100 has a solar panel 10 to charge the rechargeable battery. The circuit board is a wireless control circuit, a wireless device can be used to achieve the folding or the unfolding of the umbrella, and the wireless device comprises, but is not limited to, a remote controller, a Bluetooth mobile phone, etc.

The specific operation will be described below.

The switch is operated to control the electric air pump 6 to rotate in a forward direction, so that air is inflated into the air chamber A, and the air pressure in the air chamber A continues to rise. When the air pressure in the air chamber A exceeds the atmospheric pressure, the piston 9 is subjected to an upward force to push the inner tube 11 to slide up. At this time, the upper tray 2 and the inner tube 11 move upward, finally the umbrella frame is folded. The switch is operated to control the electric air pump 6 to rotate in a reverse direction, accordingly air is deflated from the air chamber A, and the air pressure in the air chamber A continues to drop. When the air pressure in the air chamber A is less than the atmospheric pressure, the piston 9 is driven to slide downward together with the inner tube 11. At this time, the upper tray 2 and the inner tube 11 move downward together, thereby the umbrella frame is unfolded finally achieving the open of the umbrella. After the umbrella is wholly unfolded, the piston 9 is close to the tube plug 8, and the air pressure in the air chamber A is almost vacuum, so that the piston 9 is forced to be firmly close to the tube plug 8 and the unfolded state of the umbrella frame can be maintained. After the umbrella frame is unfolded and when the long rods 4 are subjected to an external force such as wind power, the long rods 4 tend to drive the upper tray 2 and the inner tube 11 to slide up and down. Since the gas in the air chamber A cannot flow when the electric air pump 6 is not started, the air chamber A cannot form a buffering area for an external force generated by the upward or downward sliding of the inner tube 11, thereby prolonging the service life of the umbrella.

The protection scope of the present invention is not limited to each embodiment described in this description. Any changes and replacements made on the basis of the scope of the present invention patent and of the description shall be included in the scope of the present invention patent.

The invention claimed is:

1. An electrically-operated umbrella, comprising:

a column;

an upper tray;

a lower tray;

a plurality of long rods, each having a middle portion and an upper portion, each rotatably connected to the upper tray;

a plurality of short rods having two ends; and an electric air pump;

wherein, one end of each short rod is rotatably connected to the lower tray, the other end of each short rod is rotatably connected to the middle portion or the upper portion of the corresponding long rod;

the column comprises an inner tube having a top and a bottom, and an outer tube having a top, a bottom and a lower portion, the outer tube is sleeved around the inner tube, the inner tube is capable of sliding up and down relative to the outer tube in a limited range of motion;

a closed air chamber is defined between the bottom of the inner tube and the bottom or the lower portion of the outer tube;

the upper tray is connected to the top of the inner tube, the lower tray is connected to the outer tube and sleeved around the outer tube;

the electric air pump is disposed inside the inner tube to inflate or deflate the air chamber so as to drive the inner tube to slide up and down;

and the upper tray is capable of sliding up and down with the inner tube relative to the outer tube and the lower tray, so as to drive the plurality of long rods and the plurality of short rods to rotate in order to fold or unfold the umbrella.

2. The electrically-operated umbrella of claim 1, wherein a piston movable with the inner tube is disposed at the bottom of the inner tube, a tube plug is disposed at the bottom of the outer tube or inside the lower portion of the outer tube, the closed air chamber inside the outer tube is defined between the piston and the tube plug;

the electric air pump is located above the piston, the electric air pump has an air nozzle located at the bottom of the electric air pump, the air nozzle extends downward through the piston and communicates with the air chamber;

when the umbrella frame is wholly unfolded, the electric air pump exhausts the air inside the air chamber, the piston moves downward with the inner tube relative to the outer tube to resist against the tube plug to maintain the unfolded umbrella frame, and the air chamber is a buffering area for an external force.

3. The electrically-operated umbrella of claim 2, wherein the piston is detachably connected to the bottom of the inner tube, and the tube plug is detachably connected to the outer tube.

4. The electrically-operated umbrella of claim 2, wherein the piston has a vertical through hole at a middle portion of the piston for allowing the air nozzle to pass through, the piston has one or more radial connecting hole on a periphery of the piston, correspondingly, the inner tube has one or more threaded hole, the piston is connected to the inner tube through a bolt passing through the threaded hole and the corresponding connecting hole;

the bottom of the piston extends out of the inner tube, and a first sealing ring is disposed between a periphery of the bottom of the piston and an inner wall of the outer tube.

5. The electrically-operated umbrella of claim 3, wherein the tube plug has one or more radial connecting hole on a periphery of a lower portion of the tube plug, correspondingly, the outer tube has one or more threaded hole;

the tube plug is connected to the outer tube through a bolt passing through the threaded hole and the corresponding connecting hole, and a second sealing ring is disposed between a periphery of an upper portion of the tube plug and the inner wall of the outer tube.

6. The electrically-operated umbrella of claim 1, wherein a power module for supplying power to the electric air pump is disposed on the top of the inner tube at an upper end of the upper tray, the power module comprises a battery and a circuit board, and the power module is electrically connected to the electric air pump in the inner tube through wires.

7. The electrically-operated umbrella of claim 6, wherein the battery is a solar rechargeable battery, and the power module is equipped with a solar panel to charge the rechargeable battery.

8. The electrically-operated umbrella of claim 6, wherein the circuit board is a wireless control circuit, the umbrella is unfolded or folded by using a wireless device, and the wireless device comprises, but is not limited to, a remote controller, a Bluetooth mobile phone, etc.

9. The electrically-operated umbrella of claim 6, wherein the lower tray is detachably connected to the outer tube and sleeved around the outer tube.

* * * * *